US011161727B2

(12) United States Patent
Bahr et al.

(10) Patent No.: US 11,161,727 B2
(45) Date of Patent: Nov. 2, 2021

(54) HANDHELD ASSISTIVE CONTAINER OPENING DEVICE

(71) Applicant: Easy Living Solutions, LLC, Rochester, MN (US)

(72) Inventors: Kelley Milligan Bahr, Rochester, MN (US); Samuel M. Prabhakar, Rochester, MN (US); Dennis J. Veerkamp, Rochester, MN (US)

(73) Assignee: Easy Living Solutions, LLC, Rochester, MN (US)

( * ) Notice: Subject to any disclaimer, the term of this patent is extended or adjusted under 35 U.S.C. 154(b) by 324 days.

(21) Appl. No.: 16/246,386

(22) Filed: Jan. 11, 2019

(65) Prior Publication Data

US 2019/0218086 A1 Jul. 18, 2019

Related U.S. Application Data

(60) Provisional application No. 62/709,281, filed on Jan. 12, 2018.

(51) Int. Cl.
*B67B 7/16* (2006.01)
*B67B 7/14* (2006.01)
*B67B 7/18* (2006.01)

(52) U.S. Cl.
CPC ..... *B67B 7/16* (2013.01); *B67B 7/14* (2013.01); *B67B 7/18* (2013.01)

(58) Field of Classification Search
CPC ..... B67B 7/14; B67B 7/16; B67B 7/18
See application file for complete search history.

(56) References Cited

U.S. PATENT DOCUMENTS 2,625,066 A * 1/1953 Petty ..... B67B 7/18 81/3.44
D208,321 S * 8/1967 Brown ..... D8/40
3,736,817 A * 6/1973 Huff ..... B67B 7/16 81/3.15

(Continued)

OTHER PUBLICATIONS

Anonymous, "Amazon.com: OXO Good Grips Jar Opener with Base Pad", published in the World Wide Web at https://www.amazon.com/OXO-Good-Grips-Opener-Base/dp/B002DWA6KM/ . . . , publication date unknown but no later than Nov. 9, 2018.

(Continued)

*Primary Examiner* — David B. Thomas
(74) *Attorney, Agent, or Firm* — Roy W. Truelson

(57) ABSTRACT

A handheld assistive container opening device comprises two elongated arms extending from a body at an acute angle, having gripping contours on the interior arm surfaces for gripping a rotatable container cap. The arms may be rotatable though respective limited arcs about respective axes parallel to the container axis, to improve the capability to grip the cap. The device may include a movable top plate positioner, positionable over the interior of the acute angle to align a container cap with the arms, or away from the acute angle to accommodate irregularly shaped caps. The body may further include a concave finger engagement recess for application of torque from the side of a finger without gripping the device. In an exemplary embodiment, the body has the shape of an "X" with arms extending from a pair of adjacent ends at approximately 60 degrees.

20 Claims, 14 Drawing Sheets

(56) References Cited

U.S. PATENT DOCUMENTS

| | | | | | |
|---|---|---|---|---|---|
| 4,523,497 | A * | 6/1985 | Rosberg | B67B 7/18 | 81/3.44 |
| 5,154,101 | A * | 10/1992 | Wolford | B67B 7/18 | 81/3.09 |
| 5,664,466 | A * | 9/1997 | Miller | B67B 7/18 | 81/3.25 |
| 6,070,497 | A * | 6/2000 | Farelli | B67B 7/16 | 81/3.09 |
| D493,082 | S * | 7/2004 | McGuyer | D8/33 | |
| 6,837,131 | B2 * | 1/2005 | Bitonto | B67B 7/18 | 81/3.09 |
| D501,771 | S * | 2/2005 | McGuyer | D8/39 | |
| 2008/0022809 | A1 * | 1/2008 | Renner | B67B 7/18 | 81/3.44 |
| 2014/0318322 | A1 * | 10/2014 | Thrasher | B67B 7/18 | 81/3.25 |
| 2019/0276293 | A1 * | 9/2019 | Klein | B67B 7/18 | |

OTHER PUBLICATIONS

Anonymous, "Amazon.com: Rtreek Jar Opener, Jar Opener for Weak Hands, Effortless, Never Skidding, Jar Opener for Seniors with Arthritis, Jar Gripper", published on the World Wide Web at https://www.amazon.com/dp/B0784GNRF1 . . . , publication date unknown but no later than Nov. 9, 2018.

Anonymous, "Amazon.com: The Pampered Chef Jar Opener #2677", published on the World Wide Web at https://www.amazon.com/dp/B000BJUOP6 . . . , publication date unknown but no later than Nov. 9, 2018.

Anonymous, "Carol Wright Gifts: Jar and Bottle Opener, Easy Grip Stainless Steel Can Opener", published on the World Wide Web at http://www.carolwrightgifts.com/jar-and-bottle-opener-easy-grip-stainless-steel-can-opener . . . , publication date unknown but no later than Nov. 9, 2018.

Anonymous, "Easy Grip Lids Off Jar Opener Can Opener and Bottle Opener Made of Good Quality Plastic", published on the World Wide Web at https://www.dhgate.com/product/easy-grip-lids-off-jar-opener-can-opener/375481648.html, publication date unknown but no later than Nov. 9, 2018.

Anonymous, "Adjustable Gripping Tool", published on the World Wide Web at https://www.healthproductsforyou.com/p-adjustable-gripping-tool.html, publication date unknown but no later than Nov. 9, 2018.

* cited by examiner

HANDHELD ASSISTIVE CONTAINER OPENING DEVICE

CROSS REFERENCE TO RELATED APPLICATION

The present application claims priority under 35 U.S.C. 119 of U.S. Provisional Patent Application Ser. No. 62/709,281, filed Jan. 12, 2018, entitled "DIG", which is hereby incorporated by reference.

FIELD OF THE INVENTION

The present invention relates to devices which assist an individual in opening personal food or beverage containers, medicine bottles, and the like, and in particular to devices designed to assist individuals for which the ability to manually grasp and manipulate a cap, lid, top or similar part enclosing the container is significantly impaired.

BACKGROUND OF THE INVENTION

It is well known that the average age of the inhabitants of the industrialized nations of the world is increasing, and in particular that a substantial portion of the populations of those countries are or will be considered elderly. This aging of the population presents challenges to invent and design devices or improvements to devices, heretofore unknown, which accommodate older people and/or those physical limitations which, although they may occur at any age, are more commonly associated with the elderly. Often, the implementation of such devices from an engineering standpoint is not difficult, once the features of the device are conceived and its potential for improving the lives of affected individuals is appreciated.

A well known problem for many individuals is the inability or reduced ability to manually grasp and open, usually with a twisting motion, a large variety of common, everyday containers. Such containers are typically intended to be opened by holding the container body firmly with one hand, while the other hand grasps a container cap, top, lid, tip, or similar member enclosing the container, and twists or otherwise manipulates the same to open the container. Such containers often hold food or beverages, but may alternatively hold medicines, detergents or other cleaning agents, cosmetics, or any of various other products.

A reduced ability to grasp and open containers may be caused by any of various physical conditions. Perhaps the most widespread of these is osteoarthritis, but it may also be caused in whole or in part by conditions such as rheumatoid arthritis, Parkinson's disease, multiple sclerosis, cervical, spinal cord, or other nerve injury, peripheral neuropathy, toxicity from cancer treatments, wrist or finger fusions, tendon repairs, amputations, post-stroke complications, carpal tunnel syndrome, hyper-mobility syndrome, and/or reduced strength from aging.

These or other conditions may cause any of multiple specific symptoms which affect the ability to open containers. In general, any of these conditions might result in reduced grip strength, especially when attempting to grip small objects. In addition to generally reduced grip strength, some conditions might cause one or more of: pain from gripping, twisting motion, or other manipulation required to open containers; reduced motion of the joints in the wrist, hand and fingers; deformities which interfere with the placement of the fingers and hand relative to objects; reduced sensation; and/or tremors.

The general need for devices to assist certain individuals to open containers is well-known, and a variety of such devices have been developed in response to that need. However, conventional assistive devices, while offering limited assistance, tend to suffer from certain drawbacks. Some devices work well for opening containers of a particular type, but poorly or not at all for other containers. Some devices provide only a small boost to the gripping strength of an individual, relying on the user to apply substantial gripping force, which may be difficult or impossible for some users. Some devices require hand motion which is beyond the capabilities of some users. Some devices provide adequate gripping force, but are bulky or clumsy to use.

Thus, although the need for assistive devices is generally recognized, the very diversity of devices which have been offered to fulfill that need is evidence that none of the conventional devices is wholly satisfactory, and that a need still exists for improved assistive devices which overcome the limitations of the prior art and enhance the lives of people suffering from any of various physical limitations.

SUMMARY OF THE INVENTION

In accordance with the present invention, a handheld assistive opening device for opening containers comprises a pair of elongated arms extending from a body, forming or capable of forming an acute angle, and having gripping contours disposed on the interior surfaces of at least one of the arms forming the acute angle. The assistive opening device is operated by positioning a rotatable container cap within the interior of the acute angle, engaging the container cap with the gripping contours, and applying a torque to the assistive opening device to rotate the assistive opening device and container cap together about a container axis in the desired direction. For orientation purposes, a plane passing through the elongated arms and perpendicular to the intended location of the container axis when the device is positioned for opening the container is referred to as a device plane. The arms form an acute angle in the device plane.

In one inventive aspect, the arms are rotatable though respective limited arcs about respective parallel axes, the axes being perpendicular to the device plane, and therefore parallel to the intended location of the container axis. In a first (open) position, the arms align along the acute angle at respective first ends of the limited arcs, and may be used to engage the container cap. In a second (closed) position, the arms are substantially closed, and are preferably parallel to each other at respective second ends of the limited arcs. The assistive opening device includes an arm travel limiting mechanism which prevents rotation beyond the limited arcs. The rotatable arms perform a dual function of increasing the grip strength of the assistive opening device, as well as enabling the device to assume a smaller, closed position for improved portability.

In another inventive aspect, the assistive opening device includes a movable top plate positioner. The top plate positioner is capable of movement to at least two positions. In a first position, the movable top plate positioner is positioned over the interior of the acute angle, blocking the container cap from moving above the bottom surface of the top plate, thereby assisting the user to fix the position of the assistive opening device with respect to the container cap. In a second position, the movable top plate positioner is rotated away from the interior of the acute angle and does not interfere with objects within and extending above the interior of the acute angle. The second position is useful for engaging certain tall or irregularly shaped container caps, with which the top plate positioner might otherwise interfere and prevent engagement of the arms. The top plate positioner preferably rotates about an axis perpendicular to the plane of the acute angle.

In another inventive aspect, the body of the assistive opening device includes a concave finger engagement recess in at least one edge surface passing through a device plane at a substantially perpendicular angle. When the assistive opening device is engaged for opening a container, a force applied normal to the edge imparts a torque to the assistive opening device and container cap. The finger engagement recess receives one or more fingers to apply the force normal to the edge, with the palm of the hand positioned over the assistive opening device, and the one or more fingers extending downward from the palm. In this hand configuration, the force is applied by the side of the finger, near its base; the fingers are not required to grip anything or assume a fully contracted position. This inventive feature makes an assistive opening device easier to use for many users having limited hand motion and/or grasping ability.

In an exemplary embodiment incorporating all three inventive aspects, the assistive opening device comprises a body having the general shape of an "X" disposed in the device plane, the "X" forming a pair of opposite acute angles and a pair of opposite obtuse angles. The two rotatable arms are attached at two respective adjacent ends of the "X" forming one of the acute angles, the arms when rotated to the open position forming extensions of the ends of the "X" along the acute angle. The movable top plate positioner is rotatably attached to the body at a spindle at approximately the vertex of the "X". The ends of the "X" defining the obtuse angles form the edge having the concave finger engagement recess. The acute angles are preferably approximately 60 degrees.

An assistive opening device in accordance with the exemplary embodiment of the present invention may be used to open a large variety of containers having differently shaped caps, and will provide substantial gripping assistance even to individuals who have greatly impaired ability to grasp and manipulate objects. Free motion of the rotatable arms tends to lock the device onto a container cap responsive to an applied torque about the container axis, without the need for application of additional gripping force to grip the cap. The finger engagement recess further assists certain users to apply torque to the container cap without the need for gripping the device. However, the user may optionally increase the gripping force by manually compressing the rotatable arms.

The movable top plate positioner enhances the ability of the user to engage many container caps having narrow vertical profiles, while allowing the device to be used to engage a variety of irregularly shaped caps. Furthermore, the small size and collapsibility of the device permit it to be conveniently carried about in a pocket, purse, or otherwise, in circumstances which would be more difficult for bulkier devices.

The details of the present invention, both as to its structure and operation, can best be understood in reference to the accompanying drawings, in which like reference numerals refer to like parts, and in which:

DETAILED DESCRIPTION OF THE PREFERRED EMBODIMENTS

As described herein, an assistive opening device is provided for opening containers. In general, a container comprises a container body for holding the container's contents having an opening at one end thereof, and a container cap which covers the opening and encloses the contents. The container is opened by rotating the cap about an axis, herein referred to as the "container axis". Although the word "cap" is used herein to designate the member which encloses the container, this usage is not meant to imply any particular shape or construction of the cap, and the cap could be referred to as a "top", "lid", "tip", or some other term. Furthermore, the cap could be a single integrally-formed member such as a stamped metal cap, molded plastic cap, or the like, or could be a multi-part assembly having decorative and/or functional features. An example of a functional feature would be a push or squeeze mechanism for ejecting the contents of the container. Furthermore, the use herein of the term "container axis" is only for purposes of orientation with respect to the rotational motion of the cap when opening the container, and is not meant to imply that the container body or cap is necessarily cylindrical in shape or symmetrical about the container axis.

Figure 1:
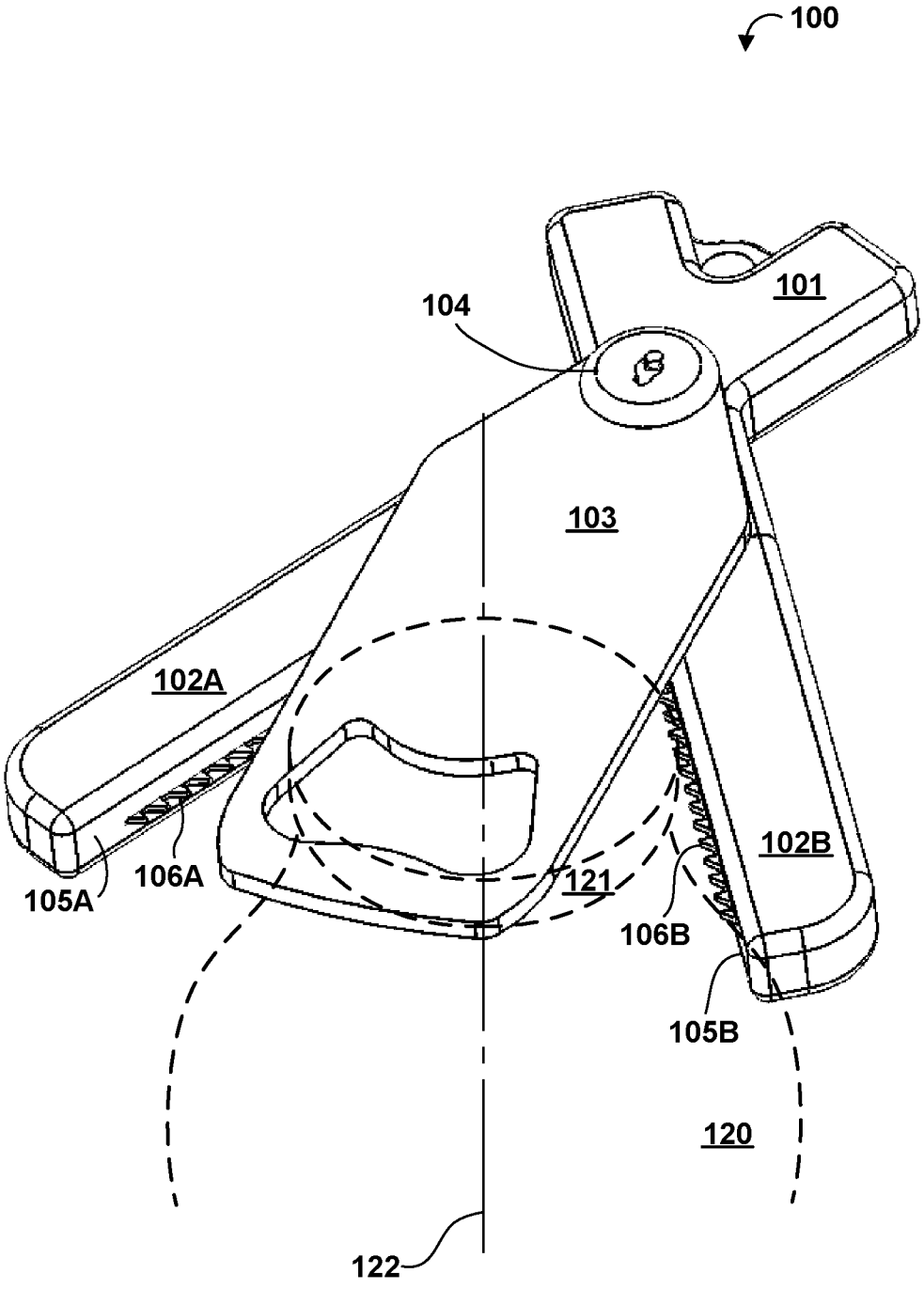
FIG. 1 is a perspective representation of an assistive opening device in an open position with top plate positioner deployed for engaging and opening a container, according to one or more embodiments of the present invention.

Referring to the Drawing, wherein like numbers denote like parts throughout the several views, FIG. 1 is a top, front perspective representation of an assistive opening device 100, according to one or more embodiments of the present invention. As shown in FIG. 1, assistive opening device 100 includes a body 101 having the general shape of an "X", a pair of rotatable arms 102A, 102B rotatably attached to the body at two respective adjacent ends of the "X", and a top plate positioner 103 rotatably attached to the body at a spindle 104 located approximately at the vertex of the "X". FIG. 1 represents the assistive opening device 100 in an open position, with arms 102A,102B rotated outward to engage a container cap of a container to be opened, and top plate positioner deployed over the space between the arms to act as a stop when positioning the assistive opening device relative to the container to be opened.

The arms 102A, 102B include respective opposed surfaces 105A, 105B facing each other, and facing the container cap when the same is positioned for opening the container. The opposed surfaces include respective gripping contours 106A, 106B for gripping and engaging a container cap when opening a container.

A representative container 120 and container cap 121 (in dashed lines), and container axis 122 appear in FIG. 1 for illustrative purposes to show the orientation of the container 120, cap 121, and container axis 122 with respect to the assistive opening device 100 when the device is engaged to open the container, it being understood that the container forms no part of the present invention. Container axis 122 is the axis of rotation of container cap 121 when the same is rotated relative to container 120 to open the container.

As shown in FIG. 1, container 120 and container cap 121 are positioned with the container cap between the opposed surfaces 105A,105B of arms 102A,102B, and in contact with gripping contours 106A,106B. For most caps, which are radially symmetrical about container axis 122, the circumferential edge of the cap is in contact with the gripping contours. Top plate positioner 103 is positioned over container cap 120 and touching the cap. When top plate positioner 103 is thus positioned, gripping contours 106A,106B on arms 102A,102B are aligned to engage the container cap for opening the container. Top plate positioner 103 thus functions as a guide to position the assistive opening device relative to the container cap, since the container cap may have a narrow circumferential edge.

Figure 2A:
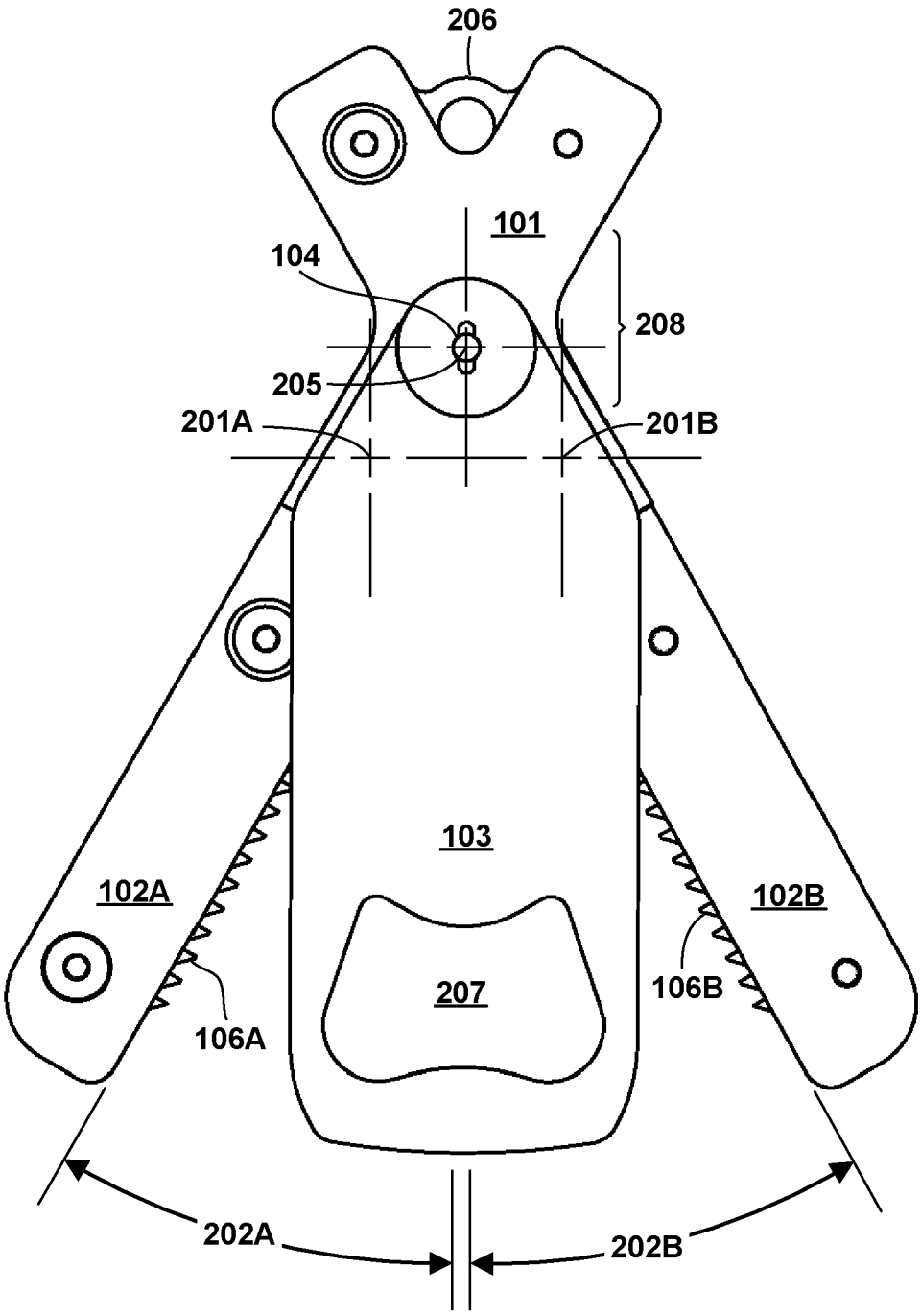
FIG. 2A is a top plan view of the assistive opening device of FIG. 1 in an open position with top plate positioner deployed, according to one or more embodiments.
Figure 2B:
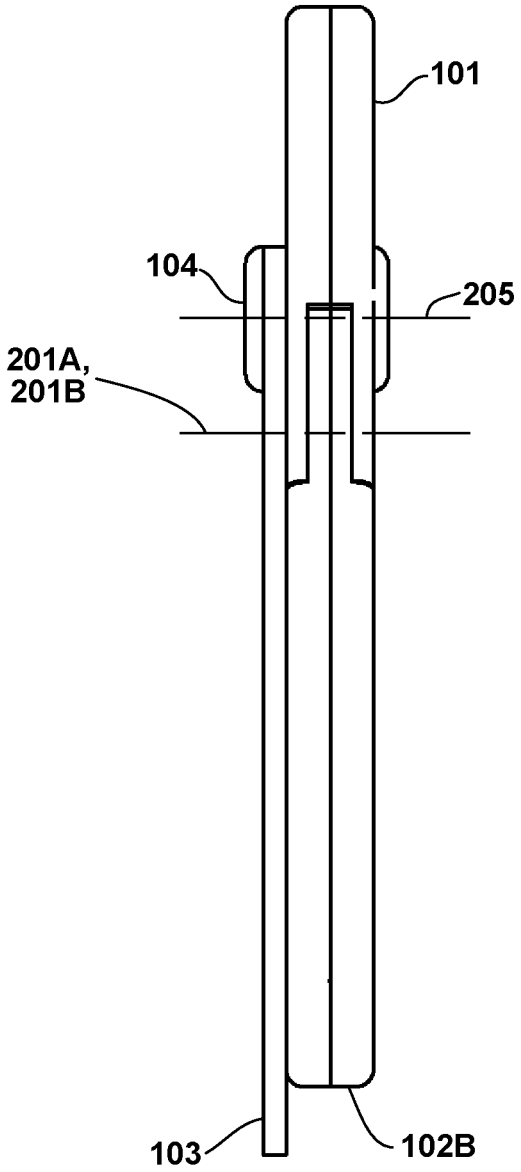
FIG. 2B is a right side view of the assistive opening device of FIG. 1 in an open position with top plate positioner deployed, the left side view being a mirror image thereof, according to one or more embodiments.
Figure 2C:
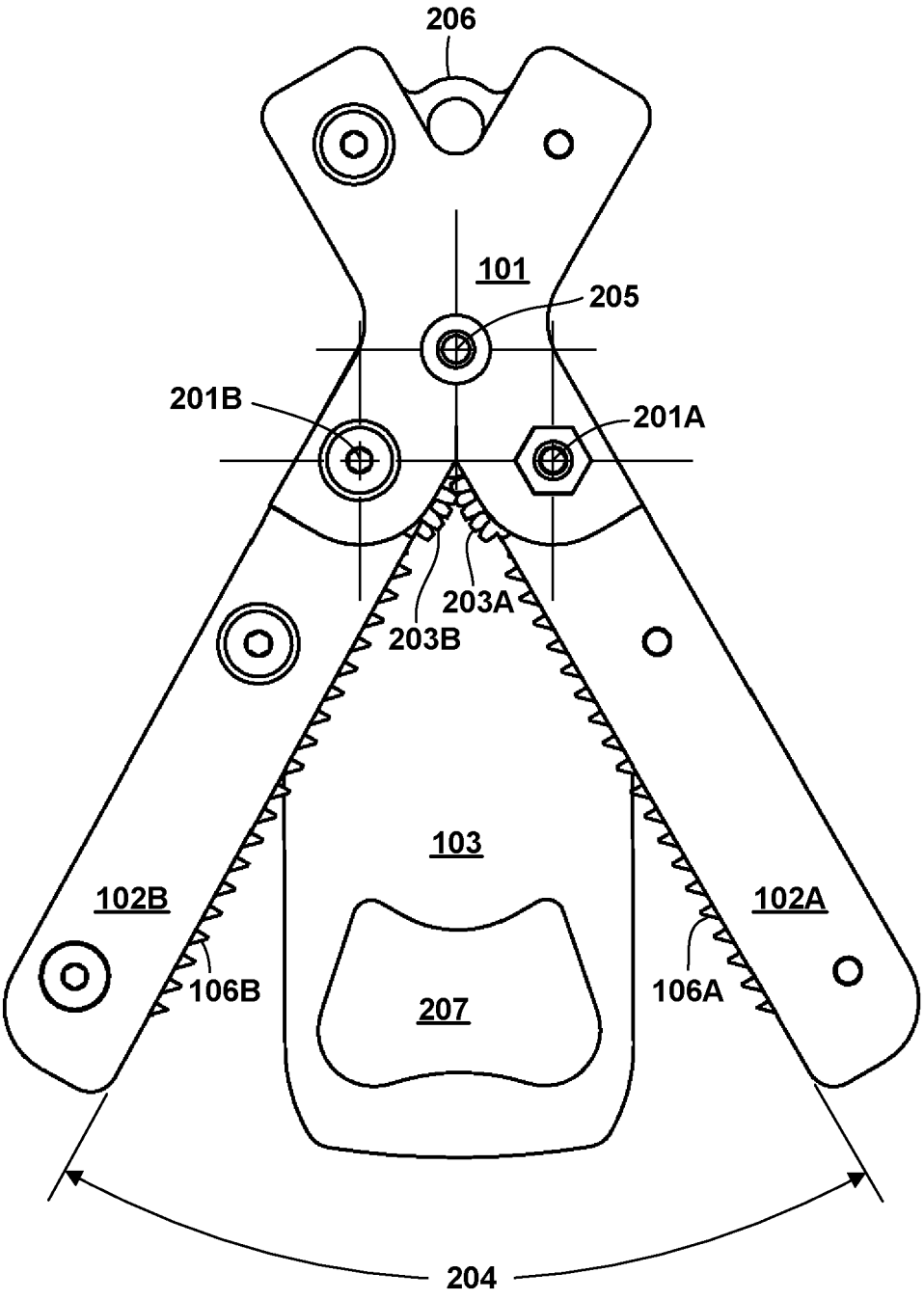
FIG. 2C is a bottom plan view of the assistive opening device of FIG. 1 in an open position with top plate positioner deployed, according to one or more embodiments.

FIGS. 2A, 2B, and 2C are a top plan view, right side view, and bottom plan view, respectively, of assistive opening device 100 in an open position, with arms 102A,102B rotated outward to engage a container cap, according to one or more embodiments of the present invention. In other words, FIGS. 2A, 2B and 2C are orthogonal views of the assistive opening device, in the same configuration as that represented in FIG. 1.

Arms 102A, 102B are rotatably attached to body 101 and rotate through respective limited rotational arcs 202A, 202B about respective arm axes 201A, 201B. Arm axes 201A, 201B are parallel to each other, parallel to the plane of the right side view of FIGS. 2B, 3B, and 4B, and perpendicular to the planes of the top and bottom orthogonal views of FIGS. 2A, 2C, 3A, 3B, 4A, and 4C. In the open position depicted in FIGS. 1, 2A, 2B, and 2C, arms 102A, 102B are rotated along arcs 202A, 202B to the outward limits of the respective arcs. In the closed position, depicted in FIGS. 3A, 3B, 3C, 4A, 4B, and 4C, the arms are rotated along arcs 202A, 202B to the inward limits of the respective arcs.

When the arms are rotated fully outward to the limits of respective arcs 202A, 202B, the opposed surfaced 105A, 105B define an acute angle 204 (shown in FIG. 2C) at which the arms engage the container cap. Because the arms' opposed surfaces 105A, 105B are straight in one or more exemplary embodiments, this acute angle is the same for different sizes of container cap which fit within the space between the opposed surfaces of the arms. In one or more exemplary embodiments, this acute angle 204 is approximately 60 degrees. However, in one or more alternative embodiments, the opposed surfaces might be curved, for example, slightly concave. In such cases, the angle at which the container cap is engaged will vary with the size of the cap. An acute angle formed by the arms could be defined by imaginary longitudinal axes of the arms lying in an arm plane perpendicular to the container axis when the container is positioned for opening, the longitudinal axes meeting to form an acute angle. For arms having straight opposed surfaces, these longitudinal axes are coincident with or parallel to the opposed surfaces. For arms having curved opposed surfaces, the longitudinal axes could be any lines approximately tangent to the opposed surfaces near the middle thereof.

Arms 102A, 102B are attached to body 101 by respective pins passing through the body and respective holes in the arms, about which the arms rotate. The pins are visible at the locations of axes 201A, 201B in FIGS. 2C, 3C, 4A and 4C, as well as in the exploded diagram of FIG. 8, but are obscured by top plate positioner 103 in FIGS. 2A and 3A.

In the exemplary embodiment, the assistive opening device further includes a gearing mechanism which synchronizes the motion of arms 102A, 102B and stabilizes the body with respect to the arms. The gearing mechanism is preferably implemented as respective sets of interlocking gear teeth 203A, 203B embedded in respective arms 102A, 102B, the teeth being located on opposed edges 105A,105B near the ends of respective arms 102A,102B attached to body 101. Gear teeth 203A,203B are visible in FIG. 2C and the exploded diagram of FIG. 8. An assistive opening device could alternatively be constructed without a gearing mechanism, or with an alternative gearing mechanism, such as a gearing mechanism in which one or more gears are interposed between the arms.

The "X" shaped body 101 forms a finger engagement recess 208 along the edge of the body at an obtuse angle formed by the "X". The obtuse angle opposite the vertex forms a mirror image finger engagement recess. For typically oriented screw-on caps, recess 208 is used to apply force for opening the container. The recess on the opposite side of the vertex of the "X" could be used for tightly closing a container, or for opening unusual containers having reverse threads.

Figure 3A:
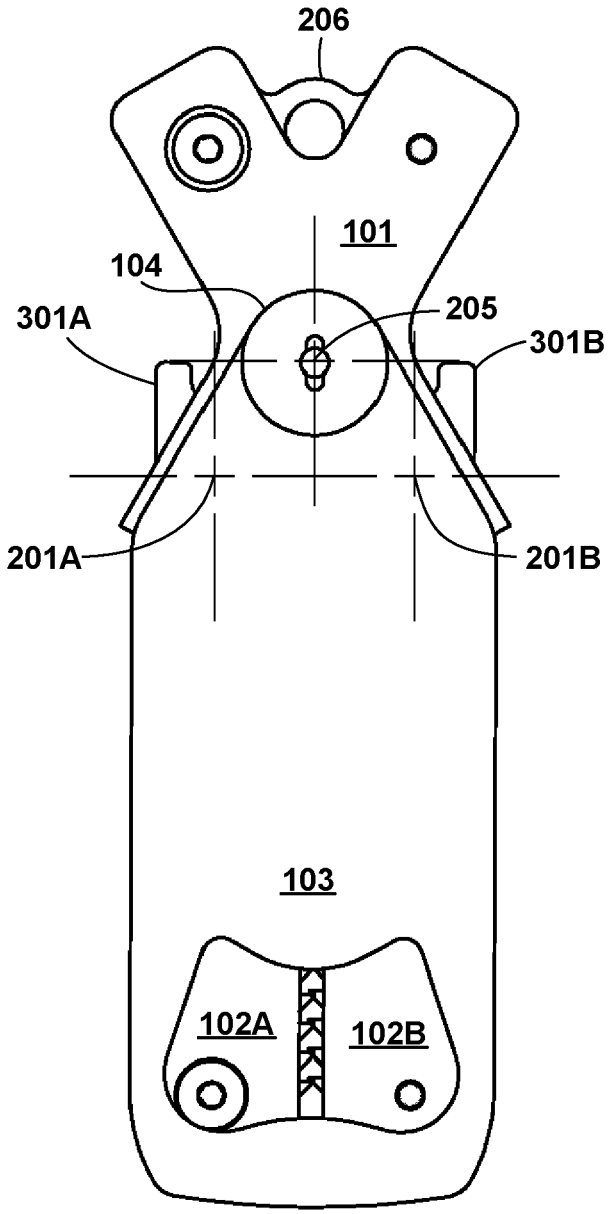
FIG. 3A is a top plan view of the assistive opening device in a closed position, according to one or more embodiments.
Figure 3B:
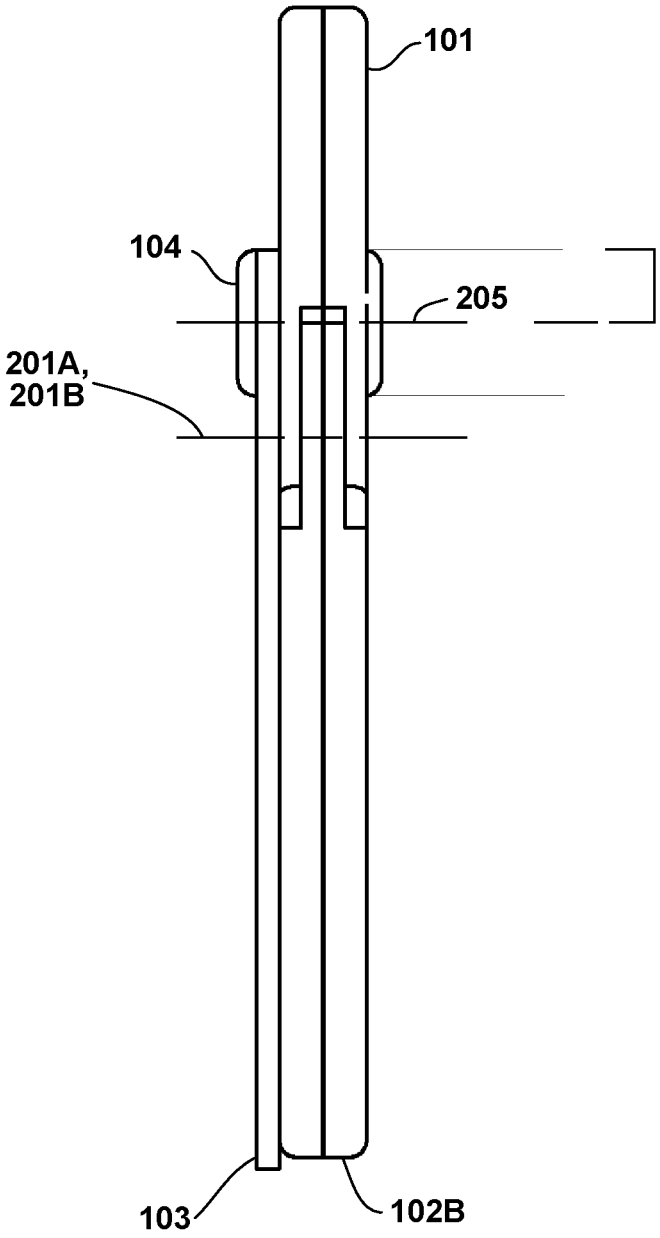
FIG. 3B is a right side view of the assistive opening device in a closed position, the left side view being a mirror image thereof, according to one or more embodiments.
Figure 3C:
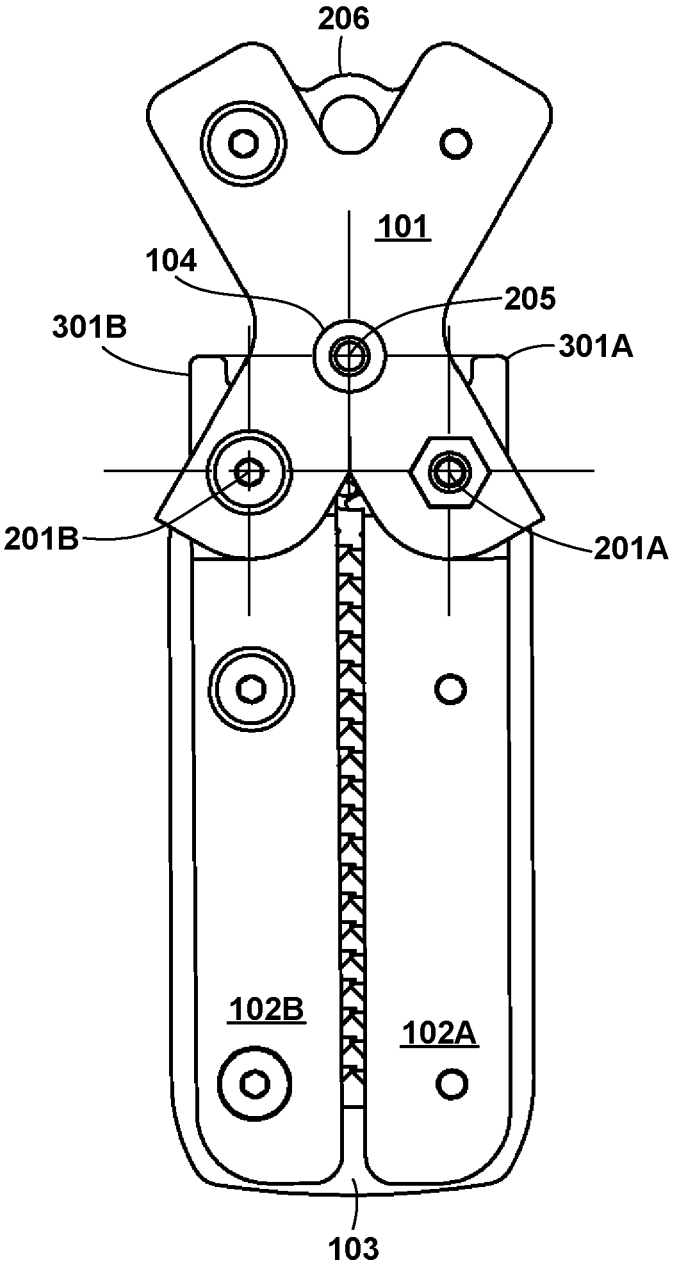
FIG. 3C is a bottom plan view of the assistive opening device in a closed position, according to one or more embodiments.

FIGS. 3A, 3B, and 3C are a top plan view, right side view, and bottom plan view, respectively, of assistive opening device 100 in a closed position, with arms 102A,102B rotated fully inward, according to one or more embodiments of the present invention. In the closed position, arms 102A, 102B are substantially parallel, and in contact with each other along their length. The closed position reduces the width of the assistive opening device for improved portability and storage.

An assistive opening device which is small enough to be conveniently carried about the person in a purse, pocket, or similar is a significant advantage. In one or more embodiments, when in the closed position depicted in FIGS. 3A, 3B and 3C, the device is not more than 6 inches in length, and in an exemplary embodiment, the device is approximately 4 inches in length. A device of approximately 4 inches in length is sufficiently large to accommodate most portable containers, such as water bottles, soft drink containers, medication containers, and the like. A larger device could accommodate a larger container such as a 1-quart pickle jar typically found in a kitchen, but not typically carried about on the person. To further improve portability, the assistive opening device of the exemplary embodiment includes a bridge 206 (visible in FIGS. 2A, 2C, 3A, 3C, and 4C) extending between two ends of the "X" in body 101 to form an enclosed hole, which may accommodate a key ring or the like.

Figure 8:
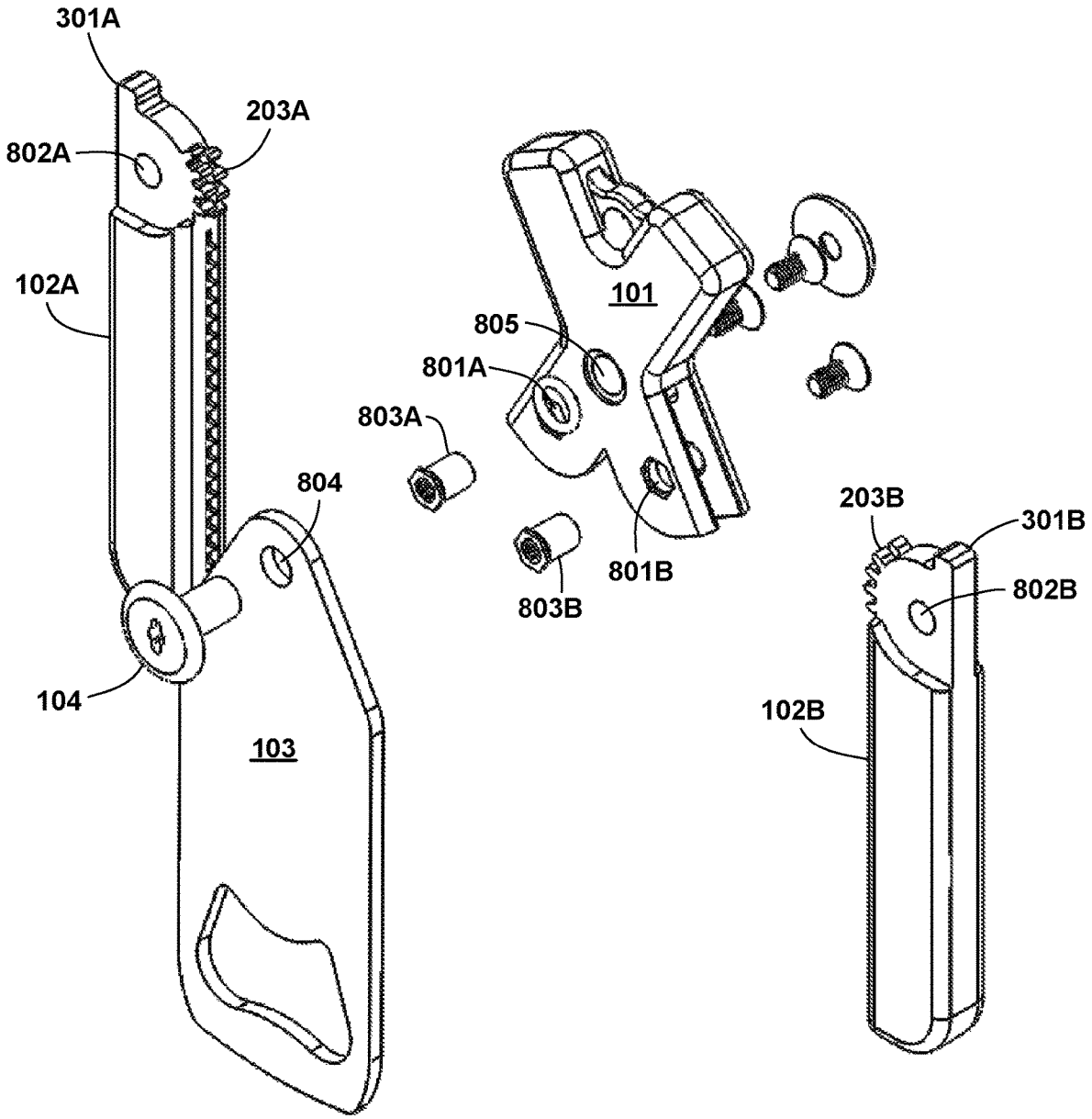
FIG. 8 is an exploded perspective representation of various major constituent parts of an assistive opening device, according to one or more embodiments.

Arm stop extensions 301A, 301B are visible in FIGS. 3A, 3C, 4A, 4C, and the exploded diagram of FIG. 8. Arms stop extensions 301A, 301B extend from the base of respective arms 102A, 102B to limit the rotational arcs 201A, 201B through which the arms rotate. As the arms are rotated to the fully open position, the respective arm stop extensions contact the body and limit further rotation beyond the open position of arcs 201A, 201B. It will be understood that alternative means of limiting arc rotation could be employed.

Figure 4A:
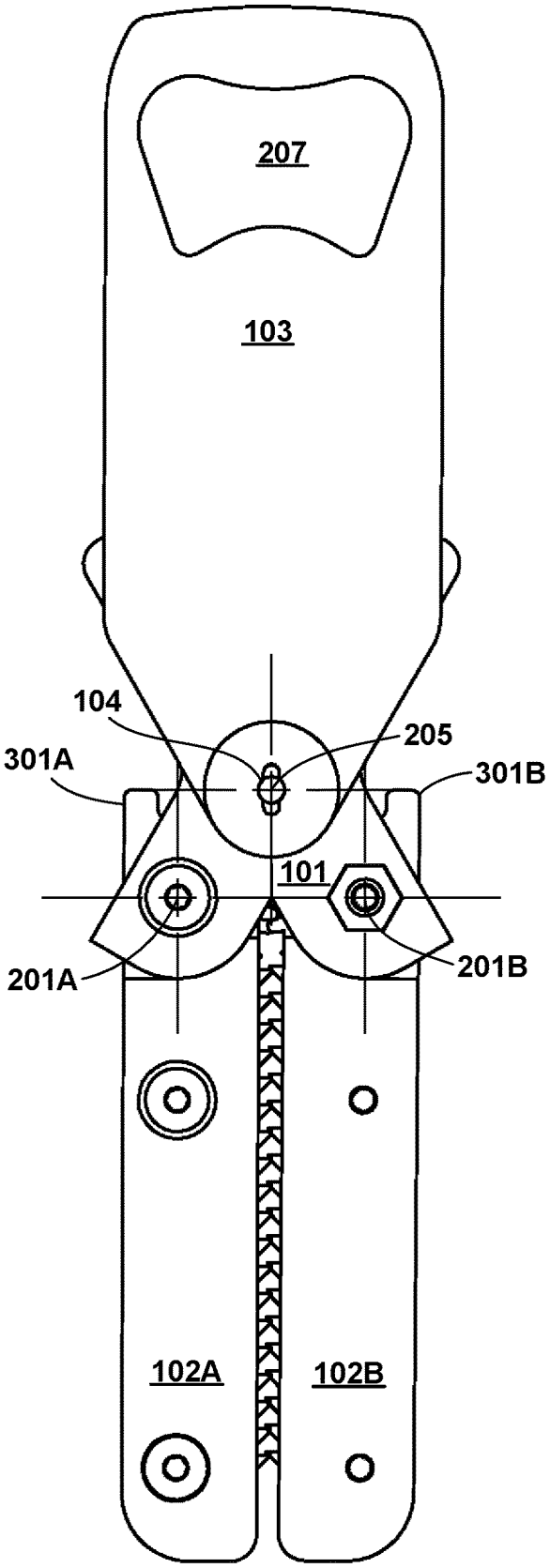
FIG. 4A is a top plan view of the assistive opening device, with the arms in a closed position and the top plate positioner rotated to the back, according to one or more embodiments.
Figure 4B:
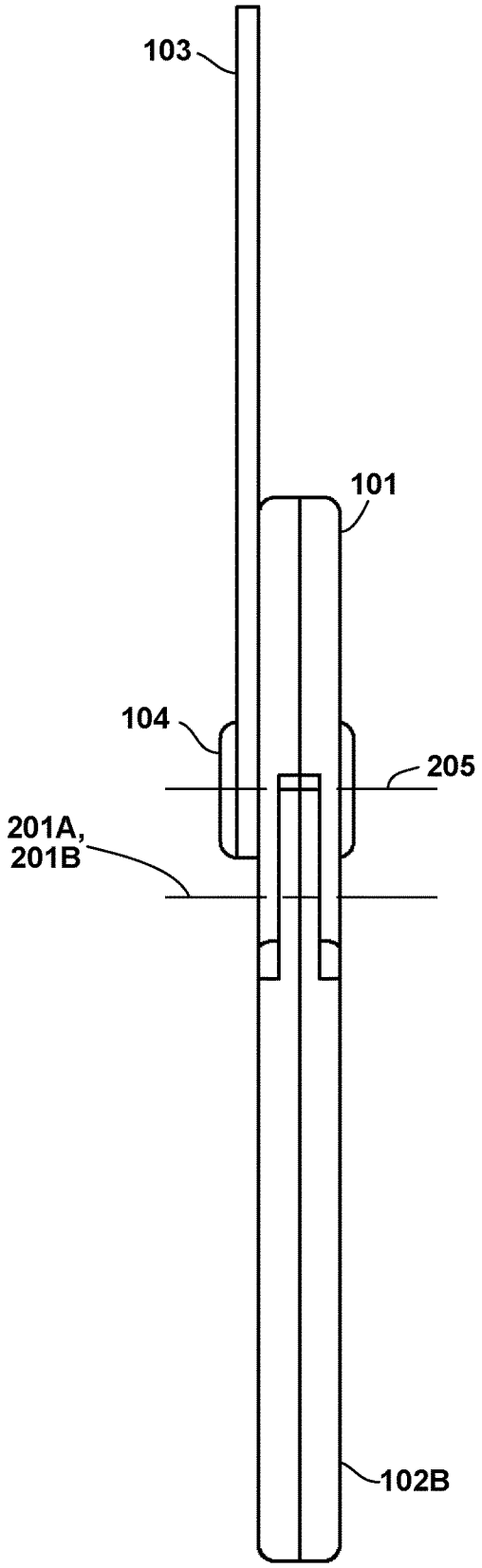
FIG. 4B is a right side view of the assistive opening device with the arms in a closed position and the top plate positioner rotated to the back, the left side view being a mirror image thereof, according to one or more embodiments.
Figure 4C:
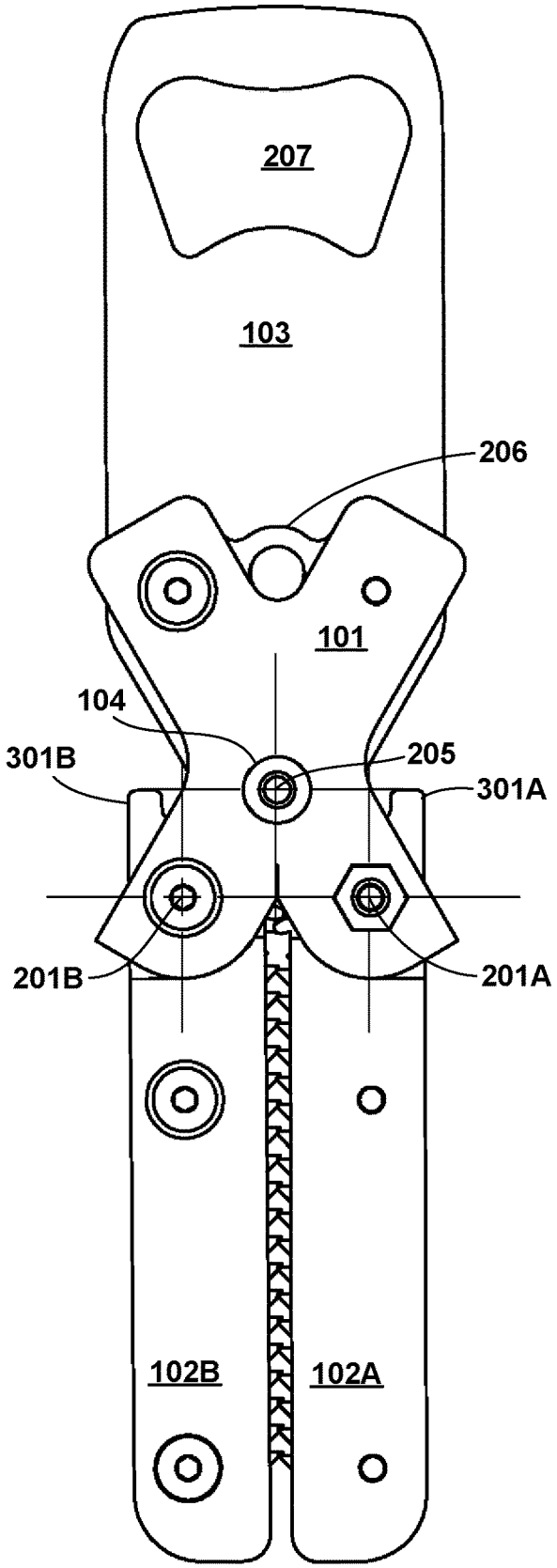
FIG. 4C is a bottom plan view of the assistive opening device, with the arms in a closed position and the top plate positioner rotated to the back, according to one or more embodiments.

FIGS. 4A, 4B, and 4C are a top plan view, right side view, and bottom plan view, respectively, of assistive opening device 100 in a closed position, with arms 102A,102B rotated fully inward, and top plate positioner 103 rotated backwards, according to one or more embodiments of the present invention.

Top plate positioner 103 is attached to body 101 at spindle 104, which passes through body 101 and is located approximately at the vertex of the "X" formed by the body. Top plate positioner 103 rotates about positioner axis 205. Positioner axis 205 is parallel to arm axes 201A, 201B, parallel to the plane of the right side view of FIGS. 2B, 3B, and 4B, and perpendicular to the planes of the top and bottom orthogonal views of FIGS. 2A, 2C, 3A, 3B, 4A, and 4C. In the exemplary embodiment, top plate positioner 103 is capable of a full 360 degrees of rotation, it being understood that a top plate positioner could alternatively have a limited arc of rotation.

The rotatable quality of top plate positioner 103 enables it to be rotated backwards, as shown in FIGS. 4A, 4B, 4C and 5, to perform certain operations. In particular, top plate positioner 103 may be rotated backwards to accommodate tall or irregularly shaped container caps between the opposed surfaces of arms 102A, 102B, with which the top plate positioner might otherwise interfere.

It will be understood that a top plate positioner could be movably attached to the body for other forms of motion. For example, a top plate positioner might be attached for sliding motion relative to the body, allowing it to slide to a first position over the interior of the acute angle formed by the arms, and to a second position away from the interior of the acute angle.

Figure 5:
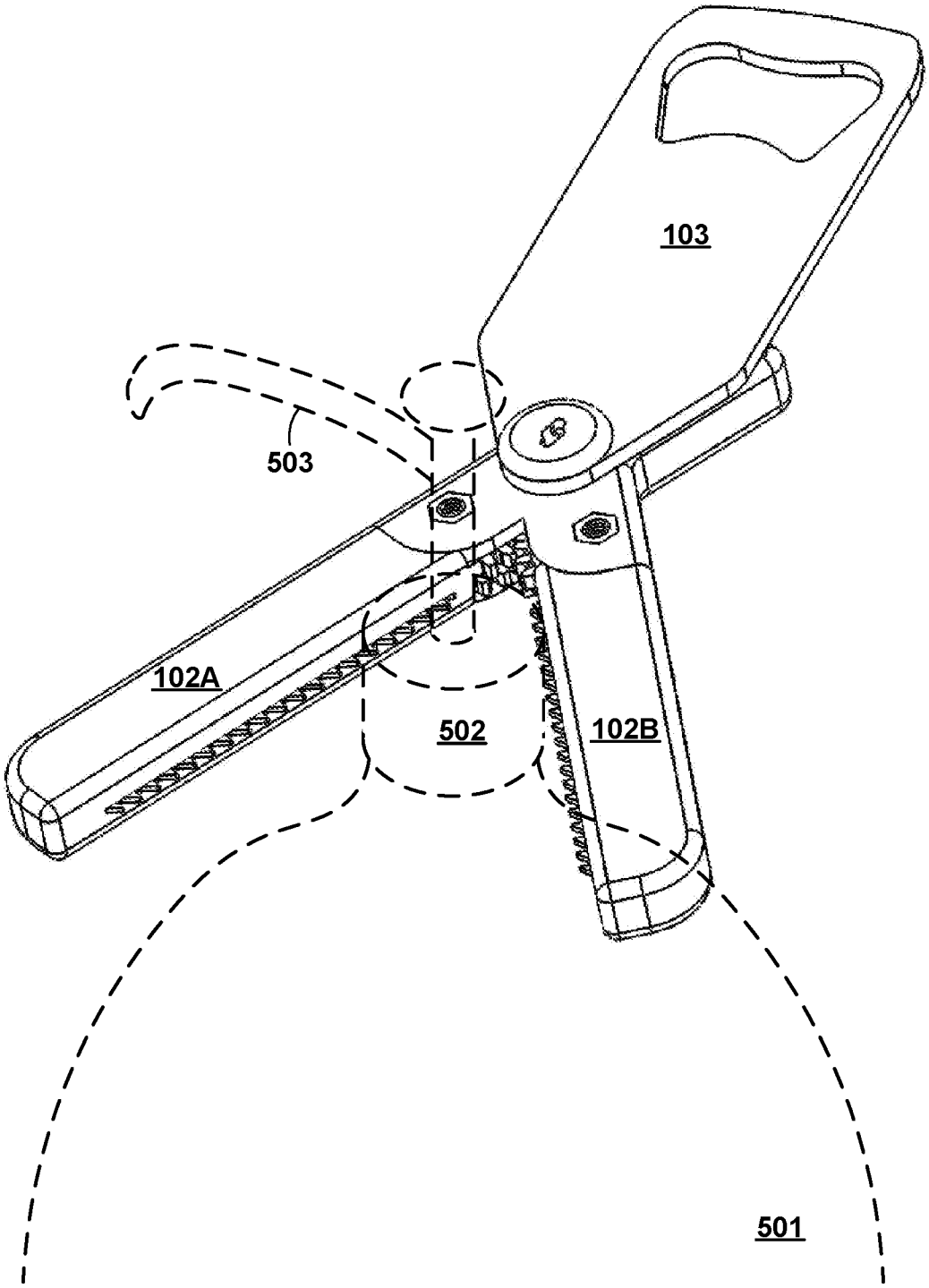
FIG. 5 is a perspective representation of an assistive opening device in an open position with the top plate positioner rotated backward for engaging and opening a container having an irregular or oversized cap, according to one or more embodiments of the present invention.

FIG. 5 is a perspective representation of assistive opening device 100 in an open position with top plate positioner 103 rotated backward for engaging and opening a container having an irregular or oversized cap, according to one or more embodiments of the present invention. In the representation of FIG. 5, a container 501 having an irregularly shaped container cap 502 is shown in dashed lines in an orientation for opening the container cap. In this example, cap 502 contains an upward extension 503 representing a push-operated dispenser assembly for dispensing soap, lotion, or the like, it being understood that an irregular container cap might include anything which would extend above the tops of arms 102A, 102B and therefore be difficult to accommodate with the top plate positioner in its forward position, as shown in FIG. 1. By rotating top plate positioner 103 backwards as shown in FIG. 5, irregular container cap 502 is easily accommodated and engaged by gripping contours 106A, 106B of arms 102A, 102B.

Figure 6:
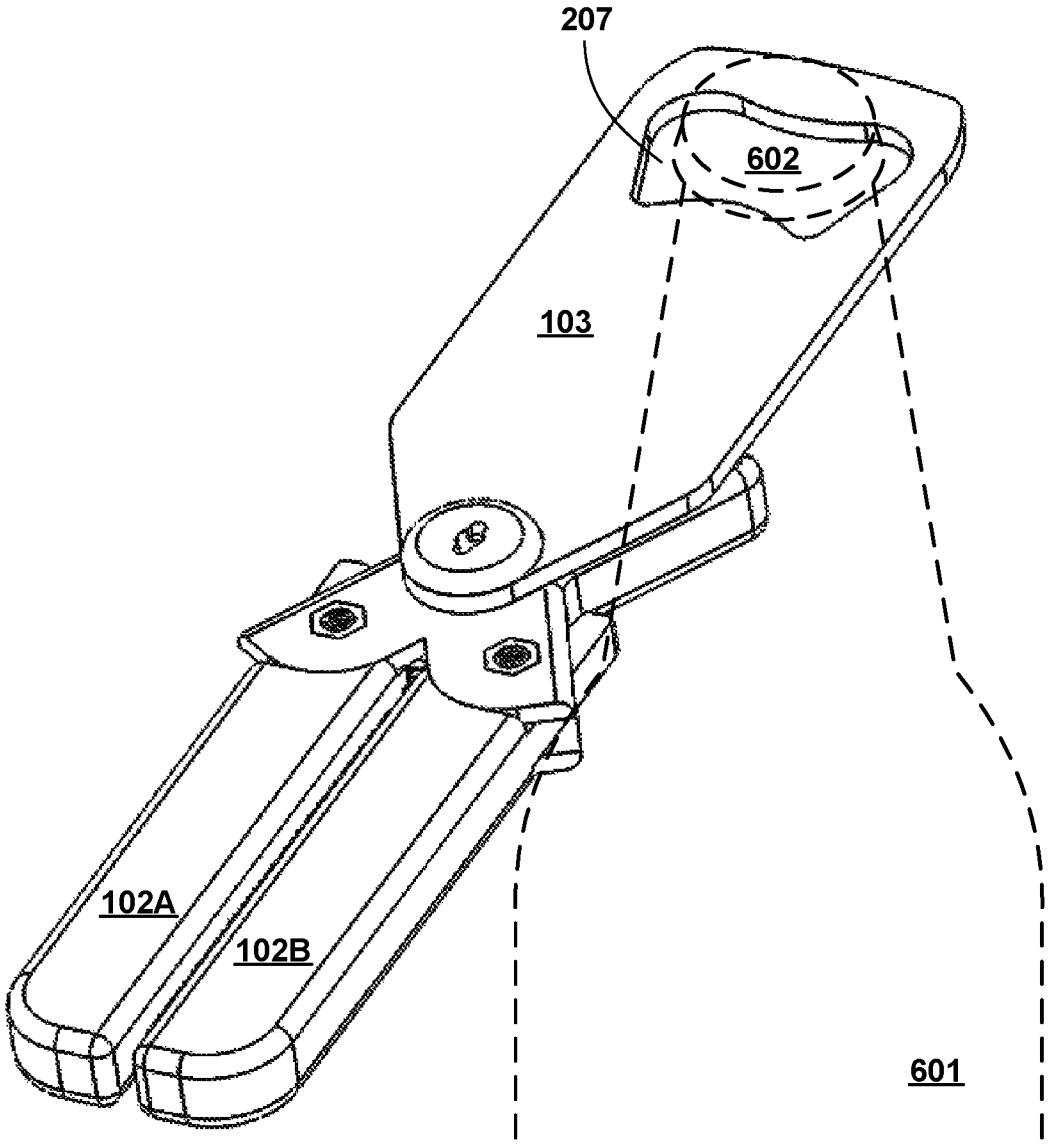
FIG. 6 is a perspective representation of an assistive opening device in a closed position with the top plate positioner rotated backward for use as a pry plate for opening a container having a pry-off cap, according to one or more embodiments of the present invention.

In the exemplary embodiment, top plate positioner contains a pry aperture 207, which is an irregularly shaped through-hole in the plate. Top plate positioner 103 can also be rotated backward to function as a pry plate for opening a container having a pry-off cap. FIG. 6 is a perspective representation of assistive opening device 100 in a closed position with top plate positioner 103 rotated backward for use as a pry plate, according to one or more embodiments of the present invention. In the representation of FIG. 6, a container 601 having a pry off cap 602 is shown in dashed lines in an orientation for opening the container cap. Cap 602 is positioned partially within pry aperture 207. Arms 102A,102B are closed and adjacent to each other to function as a handle for holding device 100 when prying off cap 602.

Figure 7:
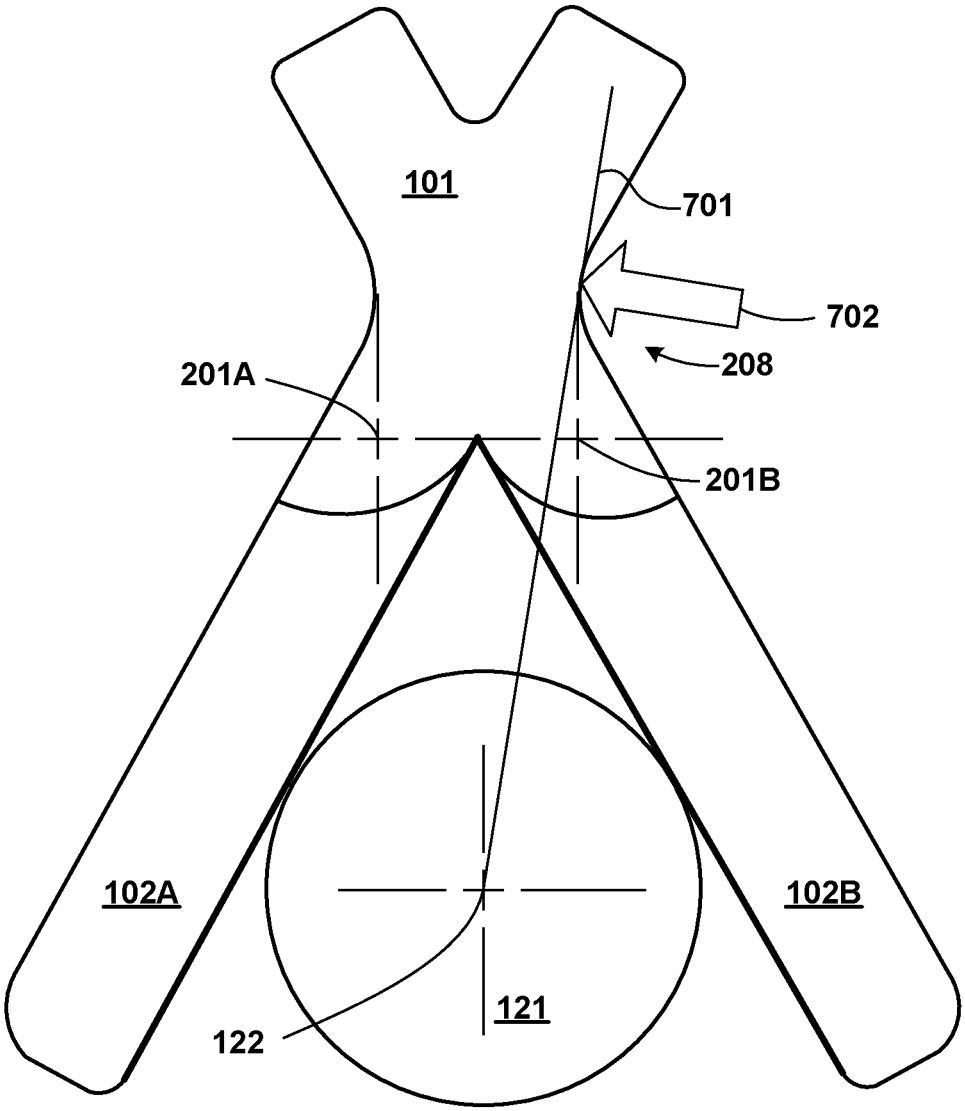
FIG. 7 is a simplified top view representation of an assistive opening device and container cap showing a direction and application of applied force for opening a container, according to one or more embodiments of the present invention.

FIG. 7 is a simplified top view representation of assistive opening device 100 and a representative container cap 121, showing a direction and application of applied force for opening a container, according to one or more embodiments of the present invention. A force 702 tangential to the container axis 122, i.e., normal to an imaginary radial line 701 drawn from the container axis to the edge of body 101 at which the force is applied, translates to a torque applied to the container cap 121 to open the container. The force 702 is optimally applied to the bottom of concave finger engagement recess 208.

Specifically, this is a location at which radial line 701 intersects the edge of body 101 at a tangent, so that when force is applied in the desired direction, a finger (or fingers) applying the force tend to be seated in the bottom of concave finger engagement recess 208 by the shape of the recess. It will be observed that the exact slope of radial line 701 and exact location at which it intersects the edge of body 101 at a tangent will vary slightly depending on the size of container cap 121, since the location of container axis 122 varies with the size of cap 121. However, due to the "X" shape of body 101, radial line 701 intersects body edge at a tangent for all sizes of container cap which fit within the space between arms 102A, 102B.

The "X" shape of body 101 and the finger engagement recess 208 support a mode of operation wherein assistive opening device is operated with the palm of the right hand spread over the top of the device, and one (or more) fingers bent downward into the space adjacent finger engagement recess 208, and pressed against body 101 at approximately the location indicated by force arrow 702. In this mode of operation, top plate positioner 103 (not shown in FIG. 7) rests on container cap to position the device with respect to the cap. Typically, operation with a single finger will employ the little ("pinky") finger at the right side of the hand, although it may also employ the finger next to it ("ring" finger), or even a different finger if the user is missing one or more fingers. With the hand thus positioned, one or more remaining fingers may extend over arm 102A on the opposite side. The device could also be operated by the left hand in a similar manner.

In the mode of operation with the palm of the right hand as described, assistive opening device will typically engage the container cap 121 when the tangential force 702 is applied by the one or more fingers. It is generally not necessary to apply a force to compress the two arms, or to grasp the device by compressing the fingers. Thus, an assistive opening device in accordance with an exemplary embodiment is suitable for use by individuals who, as a result of any of a variety of impairments, find it difficult or impossible to apply a gripping force with the fingers.

Assistive opening device 100 may alternatively be operated by holding the device between the fingers and the thumb using the small legs of the "X" as a form of handle. As a further alternative, assistive opening device may be operated by holding the arms between the thumb and one of the fingers, such as the index finger, of the hand, and holding the body by wrapping one or more fingers around it and pressing it into the palm. The assistive opening device might be held in a single hand by other means as well.

In most usages assistive opening device 100 according to the exemplary embodiment will engage and lock onto a container cap without the application of additional external force beyond the tangential force 702 needed to apply torque to turn the container cap. This locking effect is produced in part by gripping contours 106A,106B, and is further enhanced by the fact that arms 102A,102B can rotate in their respective arcs, providing a small amount of looseness to the device which increases gripping. If a device similar in outline to that shown if FIG. 7 contained arms 102A, 102B which were rigidly attached to body 101 and not rotatable, the application of force 702 would tend to pivot the device about the point of contact between container cap 121 and arm 102A, thus tending to lift arm 102B off the edge of container cap 121. In the assistive opening device of the exemplary embodiment, arm 102B counteracts this tendency because it can rotate slightly inward.

Although additional gripping force is generally not necessary, a user may optionally apply additional gripping force by compressing the two arms 102A, 102B together slightly. For example, with the palm of the right hand spread over the device as described above, a compressive force can be applied to the ends of the arms by positioning arm 102B against the base of the palm and contracting one or more fingers at the middle joint to compress arm 102A. Although this operation involves some contraction of the fingers to apply force, it is still within the means of most individuals, even those with some degree of impairment.

FIG. 8 is an exploded perspective representation of various major constituent parts of assistive opening device 100, according to one or more embodiments. The "X" shaped body 101 includes a pair of through holes 801A, 801B for arms 102A, 102B, each through hole passing through upper and lower portions of a respective leg of the "X". For assembly, the arms are placed between the upper and lower portions of the respective legs, with through holes 802A, 802B in the arms aligned with through holes 801A, 801B in the body, and secured by pin assemblies 803A, 803B. Spindle assembly 104 traverses though hole 804 in top plate 103 and through hole 805 in body 101 to rotatably secure the top plate to the body.

An assistive opening device can be manufactured using any of a variety of appropriate materials and techniques. In one or more embodiments, the body and arms are a molded thermoplastic material which can be molded by injection molding or any other suitable technique. The top plate positioner is steel to provide the strength necessary to function as a pry tool, as shown in FIG. 6 and described herein. However, if top plate positioner lacks pry aperture 207 and is not intended for opening pry-off caps, it might alternatively be made of a softer material, such as thermoplastic. In one alternative embodiment, the top plate positioner is formed of a transparent thermoplastic material to allow the user to see the container when the positioner is deployed and further assist in positioning the device.

Gripping contours 106A, 106B could be any surface feature which inhibit slip of a container cap placed adjacent the opposed surfaces 105A,105B of arms 102 when the assistive gripping device is rotated relative to the object. In the exemplary embodiment described herein, the gripping contours 106A, 106B are steel teeth formed on an edge of respective steel plates, which are embedded in respective arms. The teeth may be formed in the shape of conventional saw teeth, or in any other suitable shape to grip the container cap. In the exemplary embodiment, gripping contours 106A, 106B comprise respective sets of steel teeth which are pointed in the direction of the respective arm axis of rotation 201A, 201B.

In the exemplary embodiment, the steel plates containing the teeth forming the gripping counters are embedded between upper and lower halves of the respective arms 102A,102B. The plates are offset from each other slightly in the vertical dimension, i.e. the direction of the arm rotational axes 201A, 201B, so that when the arms are brought to a closed position, the two sets of steel teeth do not touch each other, but each set of steel teeth is placed in contact with the opposite opposed surface 105A, 105B of the opposite arm 102A, 102B. The upper and lower halves of the arm, which are preferably molded thermoplastic, may be fastened together using any of various conventional threaded fasteners to form an arm assembly. However, it will be understood that numerous variations of such a construction technique are possible. Upper and lower halves of an arm assembly could be fastened together using adhesives, snap fit elements, or other techniques. Furthermore, the teeth could be embedded in a unitary molded arm assembly at the time that the same is molded.

Although the gripping contours 106A,106B of the exemplary embodiment comprise respective sets of steel teeth, in one or more alternate embodiments, gripping contours may comprise respective contoured surfaces which are integrally formed with the arm, for example, by molding an integral arm having the contoured surface impressed by the mold at the time of molding, or by machining or otherwise forming a contoured surface on a previously formed arm. As a further alternative, gripping contours might be formed as a deformable elastomeric material having a high coefficient of friction on one or more opposed surfaces 105A,105B of arms 102A,102B. As a further alternative, different gripping contours could be used on the two arms, for example, one arm having a set of steel teeth which the other contains a deformable elastomeric material.

It will be appreciated that numerous other variations are possible in the construction of an assistive opening device, and that, in particular, different shapes of the body, arms and/or top plate positioner could be employed, that different features may be present and fewer than all of the features disclosed herein may be present, that different materials or construction techniques may be used, and that different combinations of shapes, features, materials and construction techniques may be employed.

Furthermore, although an exemplary embodiment has been described incorporated multiple inventive aspects, it will be understood that an assistive opening device could be constructed incorporating one or some inventive aspects, but not all inventive aspects. For example, an assistive opening device might contain a movable top plate positioner without having rotatable arms, or vice versa.

Although a specific embodiment of the invention has been disclosed along with certain alternatives, it will be recognized by those skilled in the art that additional variations in form and detail may be made within the scope of the following claims:

What is claimed is:

1. A handheld assistive opening device for opening containers, comprising:

a body;

a first elongated arm and a second elongated arm, the elongated arms being rotatably attached to the body, the elongated arms being rotatable through respective limited arcs about respective first and second parallel rotational axes, the elongated arms having respective first and second opposed surfaces, at least one of the first and second opposed surfaces having gripping contours disposed thereon, the rotational axes being perpendicular to an arm plane passing through the first and second opposed surfaces;

a gearing mechanism synchronizing motion of the first and second elongated arms;

wherein, at respective first positions of the elongated arms at respective first ends of the respective limited arcs, the arms form an acute angle;

wherein the handheld assistive opening device is operable with the arms in the respective first positions to open a container, the container having a container body and a container cap which is rotated about a container axis to open the container, by positioning the container cap between the opposed surfaces with the axis of rotation of the container cap substantially perpendicular to the arm plane, engaging the container cap with the gripping contours, and applying a torque to the body of the handheld assistive opening device to rotate the container cap.

2. The handheld assistive opening device of claim 1, wherein both the first and second opposed surfaces have respective gripping contours disposed thereon.

3. The handheld assistive opening device of claim 2, wherein the gripping contours comprise respective sets of steel teeth, the teeth of each respective set being pointed inward toward the respective rotational axis of the respective arm.

4. The handheld assistive opening device of claim 1, wherein at respective second positions of the elongated arms at respective second ends of the respective limited arcs, the first longitudinal axis and the second longitudinal axis are substantially parallel.

5. The handheld assistive opening device of claim 1, wherein the opposed surfaces of the elongated arms are substantially straight.

6. The handheld assistive opening device of claim 1, further comprising a top plate positioner, the top plate positioner being positionable above the arm plane over the interior of the acute angle and blocking the container cap from moving above the top plate.

7. The handheld assistive opening device of claim 6, wherein the top plate positioner is rotatable about an axis substantially perpendicular to the arm plane to a position in which it does not obstruct the container cap within the interior of the acute angle.

8. The handheld assistive opening device of claim 1, wherein the body contains a finger engagement recess at one edge thereof.

9. A handheld assistive opening device for opening containers, comprising:

a body;

a first elongated arm and a second elongated arm, the elongated arms being rotatably attached to the body, the elongated arms being rotatable through respective limited arcs about respective first and second parallel rotational axes, the elongated arms having respective first and second opposed surfaces, at least one of the first and second opposed surfaces having gripping contours disposed thereon, the rotational axes being perpendicular to an arm plane passing through the first and second opposed surfaces;

wherein, at respective first positions of the elongated arms at respective first ends of the respective limited arcs, the arms form an acute angle;

wherein the handheld assistive opening device is operable with the arms in the respective first positions to open a container, the container having a container body and a container cap which is rotated about a container axis to open the container, by positioning the container cap between the opposed surfaces with the axis of rotation of the container cap substantially perpendicular to the arm plane, engaging the container cap with the gripping contours, and applying a torque to the body of the handheld assistive opening device to rotate the container cap;

wherein the body is in the shape of an "X", and the elongated arms extend from two adjacent legs of the "X".

10. The handheld assistive opening device of claim 9, wherein both the first and second opposed surfaces have respective gripping contours disposed thereon.

11. The handheld assistive opening device of claim 9, wherein at respective second positions of the elongated arms at respective second ends of the respective limited arcs, the first longitudinal axis and the second longitudinal axis are substantially parallel.

12. The handheld assistive opening device of claim 9, wherein the opposed surfaces of the elongated arms are substantially straight.

13. The handheld assistive opening device of claim 9, further comprising a top plate positioner, the top plate positioner being positionable above the arm plane over the interior of the acute angle and blocking the container cap from moving above the top plate.

14. The handheld assistive opening device of claim 9, wherein the body contains a finger engagement recess at one edge thereof.

15. A handheld assistive opening device for opening containers, comprising:

a body;

a first elongated arm and a second elongated arm extending from the body at an acute angle, the elongated arms having respective first and second opposed surfaces, at least one of the first and second opposed surfaces having gripping contours disposed thereon, elongated arms forming at acute angle in an arm plane passing through and substantially perpendicular to the first and second opposed surfaces;

a top plate positioner movably attached to the body, the top plate positioner being capable of movement to a first position over the interior of the acute angle and to a second position away from the acute angle;

wherein the handheld assistive opening device is operable to open a container, the container having a container body and a container cap which is rotated about a container axis to open the container, by positioning the container cap between the opposed surfaces with the axis of rotation of the container cap substantially perpendicular to the arm plane, engaging the container cap with the gripping contours, and applying a torque to the body of the handheld assistive opening device to rotate the container cap.

16. The handheld assistive opening device of claim 15, wherein the top plate positioner is rotatably attached to the body and rotates about an axis substantially perpendicular to the arm plane.

17. The handheld assistive opening device of claim 15, wherein both the first and second opposed surfaces have respective gripping contours disposed thereon.

18. The handheld assistive opening device of claim 15, wherein the opposed surfaces of the elongated arms are substantially straight.

19. The handheld assistive opening device of claim 15, wherein the top plate positioner comprises a pry-off aperture operable to engage a pry-off container cap.

20. The handheld assistive opening device of claim 15, wherein the body contains a finger engagement recess at one edge thereof.

* * * * *